US005105473A

United States Patent [19]

Valtakari

[11] Patent Number: 5,105,473

[45] Date of Patent: Apr. 21, 1992

[54] SPORTS OUTFIT HAVING ELASTIC FABRIC POCKETS FOR INSERTABLE RESILIENT PADDING

[75] Inventor: Antti Valtakari, Siuro, Finland

[73] Assignee: Rukka Luhta Oy, Tampere, Finland

[21] Appl. No.: 584,133

[22] Filed: Sep. 18, 1990

[30] Foreign Application Priority Data

Sep. 10, 1990 [FI] Finland ..... 904442

[51] Int. Cl.[5] ..... A41D 13/00

[52] U.S. Cl. ..... 2/2; 2/227; 2/267; 2/46; 2/22; 2/23; 2/24

[58] Field of Search ..... 2/2, 23, 24, 22, 46, 2/227, 267

[56] References Cited

U.S. PATENT DOCUMENTS

| | | | |
|---|---|---|---|
| 2,135,213 | 11/1938 | Luery et al. | 2/23 |
| 3,168,746 | 2/1965 | Smith | 2/24 |
| 3,670,339 | 6/1972 | Cooper et al. | 2/22 |
| 3,991,420 | 11/1976 | Savarino | 2/16 |
| 4,091,466 | 5/1978 | Kearn | 2/23 |
| 4,193,134 | 3/1980 | Hanrahan | 2/16 |
| 4,397,636 | 8/1983 | Ganshaw | 2/2 |
| 4,455,686 | 6/1984 | Zide | 2/23 |
| 4,479,269 | 10/1984 | Balliet | 2/23 |
| 4,561,123 | 12/1985 | Hull | 2/23 |
| 4,561,124 | 12/1985 | Thompson | 2/23 |
| 4,700,407 | 10/1987 | Mattila | 2/23 |
| 4,831,666 | 5/1989 | Denman | 2/23 |
| 4,894,867 | 1/1990 | Ceravolo et al. | 2/23 |
| 4,920,577 | 5/1990 | Scharf | 2/22 |
| 4,987,613 | 1/1991 | Loverdi et al. | 2/23 |

FOREIGN PATENT DOCUMENTS

| | | | |
|---|---|---|---|
| 971703 | 7/1975 | Canada | 2/23 |
| 1123157 | 5/1982 | Canada | 2/24 |
| 1123552 | 5/1982 | Canada | 2/24 |
| 3638718 | 8/1987 | Fed. Rep. of Germany | 2/23 |
| 2082043 | 3/1982 | United Kingdom | 2/24 |

*Primary Examiner*—Werner H. Schroeder
*Assistant Examiner*—Gloria Hale
*Attorney, Agent, or Firm*—Watson, Cole, Grindle & Watson

[57] ABSTRACT

An athletic garment for use in different sports includes trousers and/or a coat which have outer pad pockets attached thereto, the pad pockets including hook and loop type closure tapes and being made of an elastic material so that pads for the protection of the wearer can be inserted into and withdrawn from the respective pad pockets.

8 Claims, 3 Drawing Sheets

FIG. 1
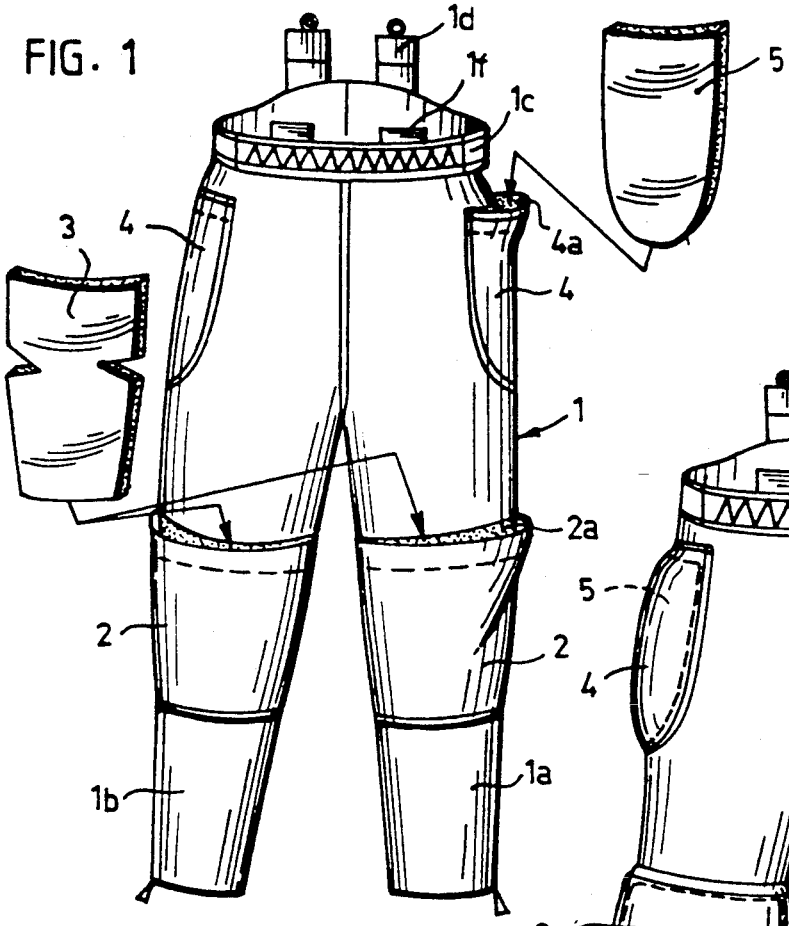
FIG. 2
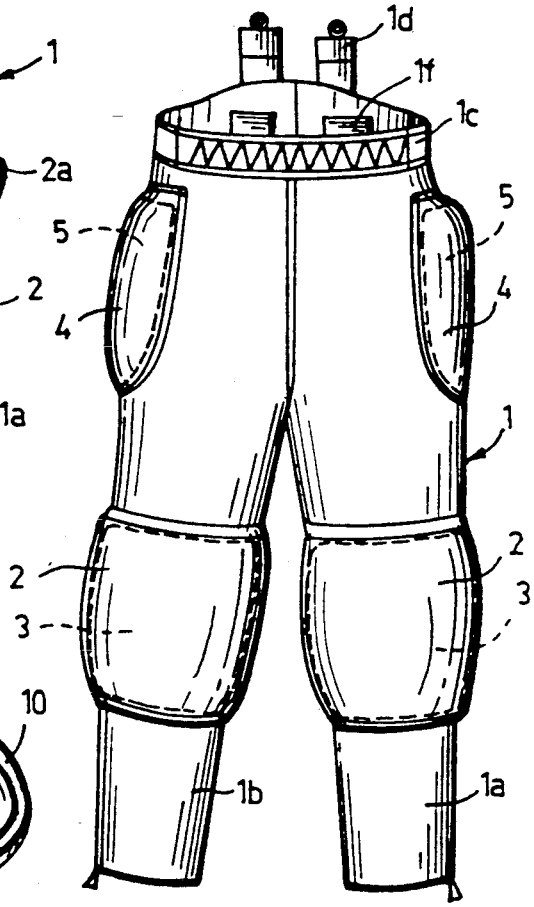
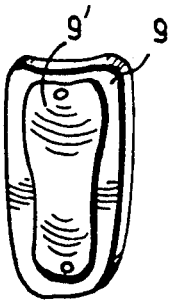
FIG. 5A
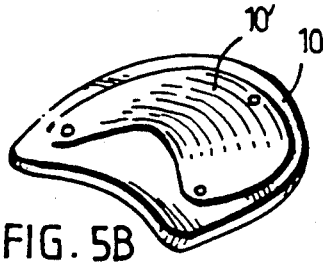
FIG. 5B
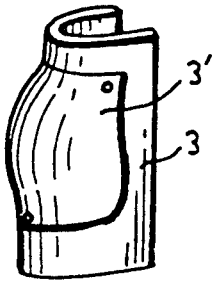
FIG. 5C
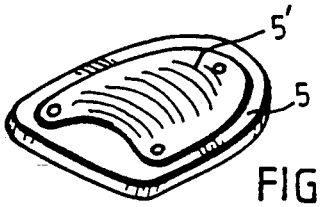
FIG. 5D FIG. 6a
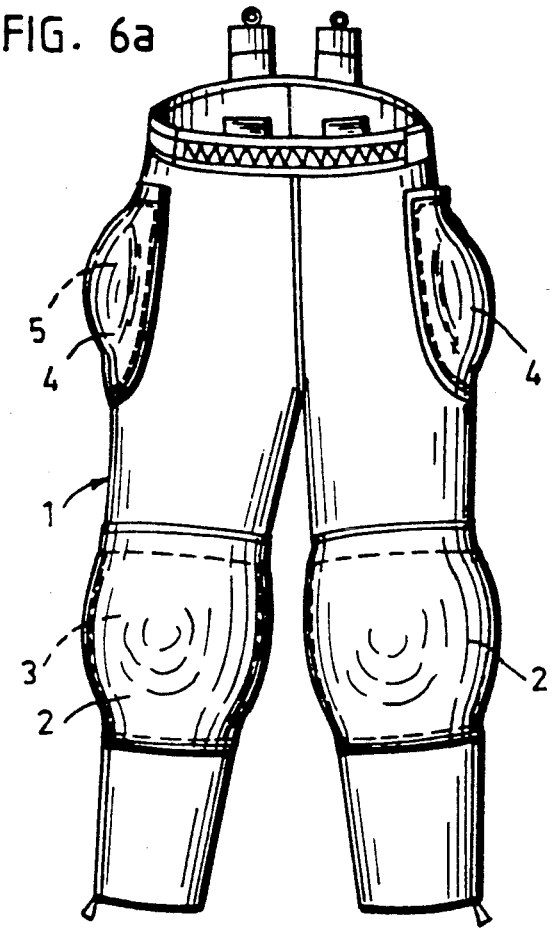
FIG. 6b
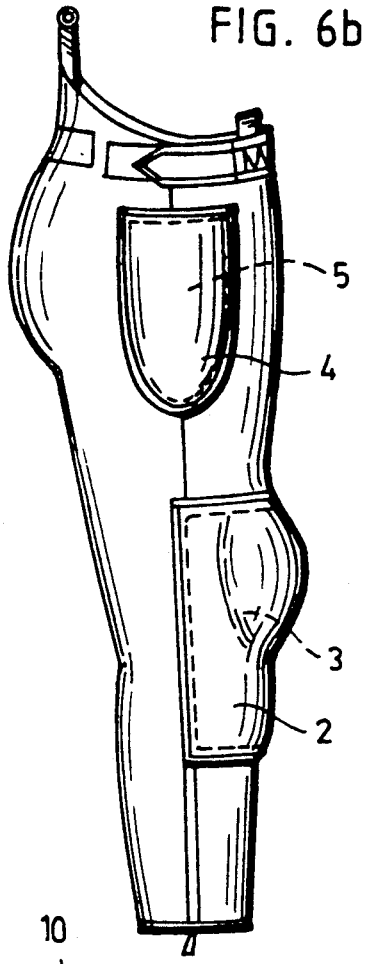
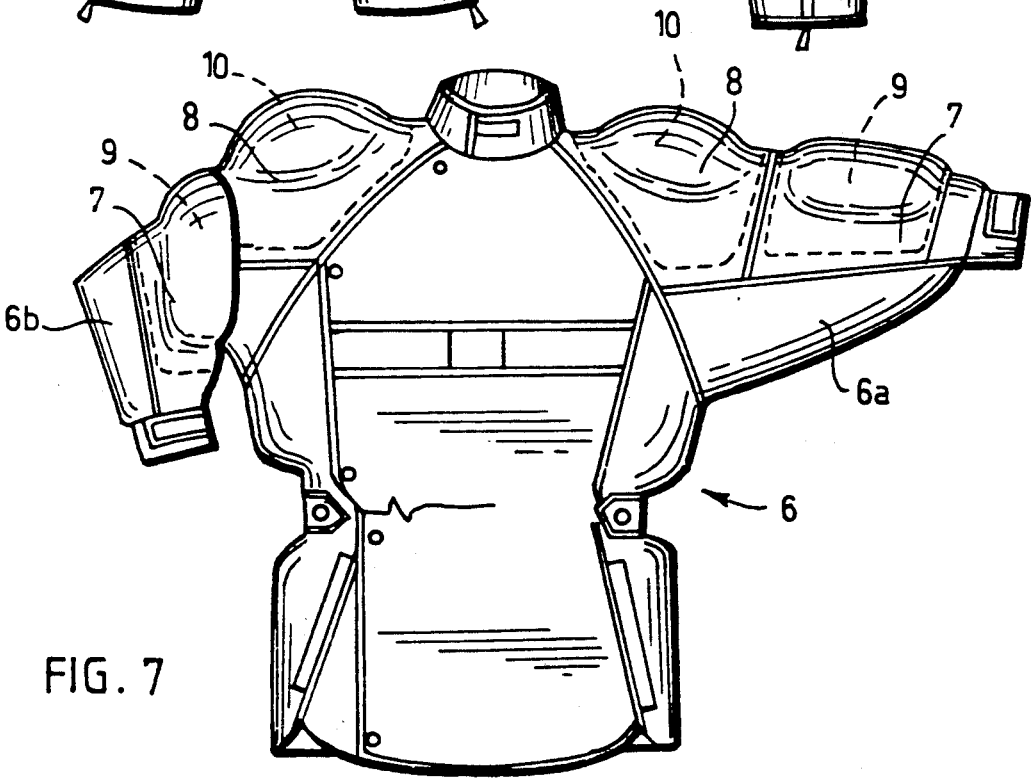
FIG. 7

SPORTS OUTFIT HAVING ELASTIC FABRIC POCKETS FOR INSERTABLE RESILIENT PADDING

BACKGROUND OF THE INVENTION

The invention relates to an athletic outfit which includes is one or more garments an is made of an elastic material or a material combination which is permeable to steam and is preferably impermeable to water drops.

Various athletic outfits are worn both as clothing and as protection against falling or similar accidents. Examples of sports in which garments such as trousers, blouse and overalls act as protection are motor racing, downhill skiing, yachting, etc. In competitive sports in particular, such as downhill racing, yacht racing, enduro or motorcross, certain body portions, such as various joints, shoulders, thighs, etc, have to be protected against blows or rubbing by means of shock absorbers.

It is well-known to provide an athletic outfit with separate detachable pads and support belts as well as seat cushions and the like attached to the inside of the outfit by VELCRO® hook and loop tapes, for instance. A drawback of such pads is that they are inconvenient in use, in addition to which the pads may be detached or they can move away from their proper position, especially during strain and movement of longer duration. This, of course, impairs the protective effect of the pad, which may hamper athletic performance and cause additional problems in case of accident.

U.S. Pat. No. 4,700,407 further discloses a protective athletic outfit of elastic basic material to which elastic shock-absorbing pads are attached. The pads are placed in openings made in the basic material and attached to it in such a manner that part of the cloth layer protecting the wearer consists solely of the pads. A drawback of this solution is that the protective outfit has to be designed separately for each specific sport. Indeed one sport max involve different requirements; for instance, ordinary downhill skiing requires less protection than downhill racing. This implies that the pads have to be of predetermined kind and design and pads of different kinds cannot be used with one and the same outfit with varying requirements.

SUMMARY OF THE INVENTION

The object of the present invention is to provide a versatile, protective athletic outfit which can be used as sports clothing and which can be modified according to each specific sport and its requirements in such a way that it is always provided with sufficient padding. This is achieved according to the invention in such a way that openable and closeable pad pockets of an elastic material are attached to the outer surface of the athletic outfit at points where the body of the wearer possibly needs protection, separate pads being arranged to be inserted into the pockets in such a way that the inner dimensions of the athletic outfit remain substantially unchanged while the pocket material stretches according to the pad fitted therewithin, whereby the pad positioned within the closed pad pocket remains in place in spite of a blow or other force possibly exerted on it.

The basic idea of the invention is that openable and closeable pad pockets of elastic material are provided on the outside of the outfit according to the requirements of each specific sport. Depending on the sport and its requirements, pads of different kinds and different protecting properties can be placed in the elastic pad pockets, where they are kept in position by the edges of the pad packet, while the inner dimensions of the sports outfit remain unchanged. An advantage of the athletic outfit of the invention is that the wearer is able, when participating in more than one sport or with varying protective requirements, for instance, when driving motor-cross or enduro or some other motorbike racing, to place suitable pads in the pockets so that the outfit is as purposeful as possible, offers sufficient protection, and one and the same outfit can be used for different sports and with different requirements. A further advantage of the invention is that when the athletic outfit is made of a suitable material, it can be worn as such, i.e., without pads, in sports which do not require any protection, whereby one only needs one basic outfit to which pads suited for the desired sport can be attached. Especially when the athletic outfit of the invention is made of CORDURA® fabric having so-called GORE-TEX® coating, it is rain-proof but airy, and sufficiently firm to serve as such as a protective outfit, which is light and pleasant to wear normally.

The invention will be described in greater detail in the attached drawings.

BRIEF DESCRIPTION OF THE DRAWINGS

FIG. 1 shows by way of example in a front view the trousers of the athletic outfit of the invention without pads;

FIG. 2 is a front view of the trousers of FIG. 1 with light pads positioned in place;

FIGS. 5A–5D show by way of example thick pads for the trousers and the coat;

FIGS. 6*a* and 6*b* show the trousers of FIG. 1 with thick pads in place from the front and from the sides, respectively; and FIG. 7 is a front view of the coat of FIG. 3 with the thick pads fitted in place.

DETAILED DESCRIPTION OF THE PREFERRED EMBODIMENTS

Figure 3:
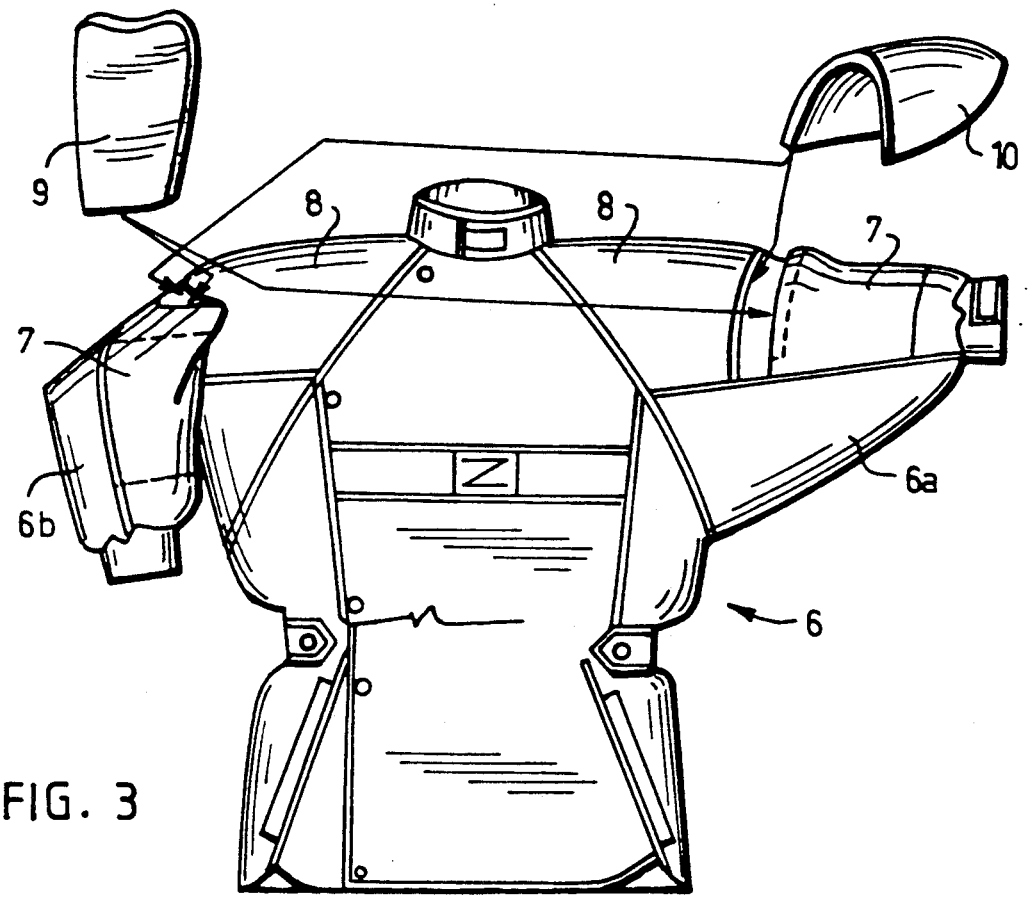
FIG. 3 shows by way of example in a front view the cost of the athletic outfit of the invention without pads.

FIG. 1 shows the trousers 1 of the athletic outfit, comprising trouser legs 1*a* and 1*b*. The trousers further comprise a conventional waist member 1*c* usually comprising a rubber band or some other similar elastic member to provide elasticity, and fastening means by means of which the waist member can be opened and closed for taking off and putting on the trousers. These parts are well-known per se and will not be described in any greater detail here. The trousers may further comprises fasteners 1*d* and 1*f* for fastening the trousers 1 to the coat of the sports outfit or for suspending the trousers with braces. These parts and solutions are also known per se and will not be described in greater detail here.

According to the invention, various pockets for pads are provided on the outside of the trousers 1. In FIG. 1, the trouser knees are provided with pad pockets 2 having an openable opening at the upper edge. The edges of the openings are provided with VELCROX® hook and loop tape closers 2*a*, for instance, by means of which the pad pocket 2 can be closed firmly and reliably. When the pocket is open, a pad of desired size can be inserted into it. In FIG. 1, the reference numeral 3 indicates a light pad suitable for the athletic outfit of the invention. The pad 3 can be inserted into the pad pocket 2 through its opening so that it substantially fills the pocket and is kept in position by the edges of the pocket. The pads 3 are made of a sheet of foamed or other similar elastic material which absorbs shocks when compressed, such as felt, or a combination of different materials. The outer dimensions of the pads 3 are such that they can be passed into the pad pockets 2 in such a way that they bear against the edges of the pad pocket 2 on all sides, so that they cannot be displaced away from their normal position under stress. The trousers 1 further comprise pad pockets 4 in the area of the hips of the wearer. Similarly as the pad pockets 2, the pockets 4 are provided with VELCRO® hook and loop tape closers 4*a* at the upper edge. FIG. 1 also shows light pads 5 intended to be inserted into the hip pad pockets 4 through the opening at the upper edge of the pocket whereafter the pad pocket is closed by the VELCRO® hook and loop tape. The hip pads 5 may be of the same material as the knee pads 2, such as a foamed, fibrous, or other such sheet material. Alternatively, they can be of different materials according to the kind and strength of possible blows.

FIG. 2 shows the athletic trousers of FIG. 1 with the light pads 3 and 5 positioned in the pad pockets 2 and 4, respectively, to protect the wearer against less severe knocks and blows. The athletic trousers of the invention are made mainly of a wear-resistant, preferably airy but nevertheless rainproof basic material, such as CORDURA TM. The basic material may be covered with a coating permeable to steam but impermeable water drops, such as GORE-TEX®. The trousers can thereby be worn even in sports causing high strain and sweating without the wearer getting wet and feeling uncomfortable. The pad pockets 2 and 4 are made of an elastic material so that the pads can be inserted into the pockets while the pockets stretch outwardly of the garment. The inner dimensions of the garments thereby remain substantially unchanged as the volume required by the pads is taken from outside the garment on account of the elastic pad pockets. Otherwise the structure and materials of the trousers can be chosen in a manner known per se according to the requirements in each particular case.

FIG. 3 is a front view of the coat 6 of the athletic outfit of the invention. The coat comprises sleeves 6*a* and 6*b* each one of which is provided with a pad pocket 7. In addition, the shoulder of the coat is provided with a shoulder pad pocket 8. The coat is usually made of the same or similar material as the trousers 1, and the structure of the coat can otherwise be completely conventional and purposeful. Similarly, the sleeve pad pocket 7 and the shoulder pad pocket 8 are made of the same or substantially similar material as the pad pockets 2 and 4 of the trousers, so that they are elastic and keep the pads reliably in position. The sleeve pad pocket 7 and the shoulder pad pocket 8 open towards each other so that the boundary between them extends substantially along the edge of the shoulder. The openings of the pad pockets 7 and 8 are provided with VELCRO® hook and loop tapes, for instance, similarly as the pad pockets 2 and 4. The pockets can be closed by means of the tapes and correspondingly opened for the insertion of various pads. FIG. 3 further show a light forearm pad 9 and a light shoulder pad 10 made of a sheet of foamed material, for instance. These pads can be inserted into the pad pockets 7 and 10, respectively, to protect the wearer of the coat.

Figure 4:
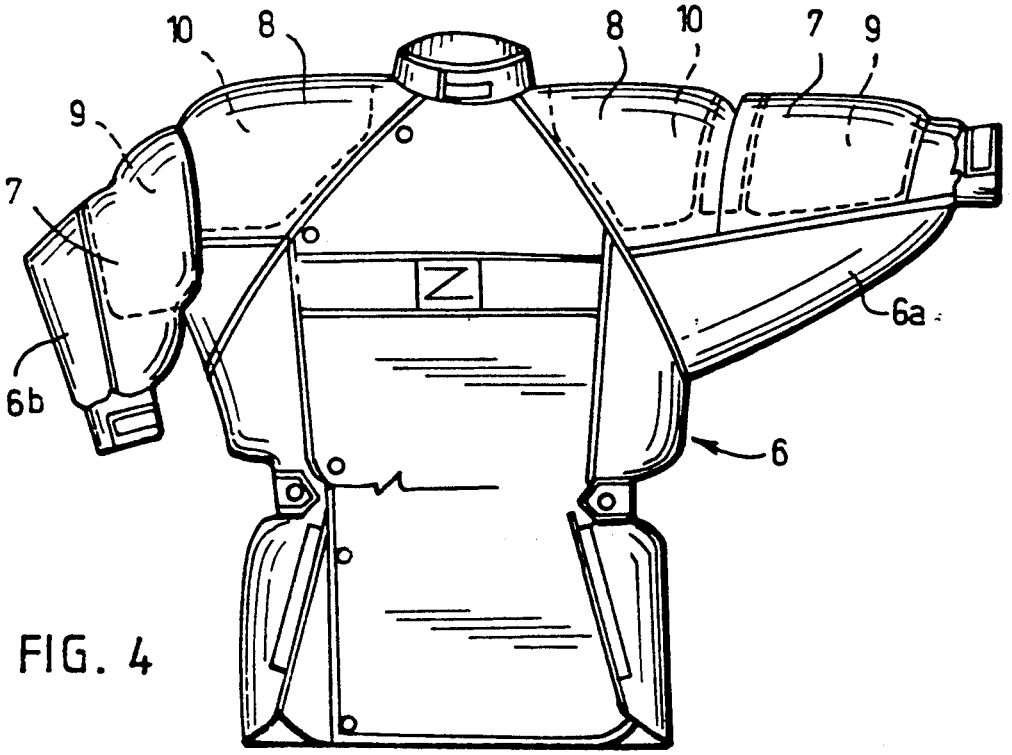
FIG. 4 shows the coat of FIG. 3 with light pads positioned in place.

FIG. 4 shows the coat of FIG. 3 with the light pads inserted into the sleeve and shoulder pad pockets 7 and 8, respectively.

FIGS. 5A-5D show by way of example thick pads to be inserted into the pad pockets 2 and 4 of the trousers of FIG. 1, and thick pads to be inserted into the pad pockets 7 and 8 of the coat of FIG. 3.

The pads mainly consist of a protective sheet 3, 5, 9 or 10 of foamed material or the like. The dimensions of the sheet are substantially equal to those of the pockets. In addition, a protective cup 3', 5', 9' or 10' of a material highly resistant to blows and rubbing, such as plastic, is attached to the sheet.

FIGS. 6*a* and 6*b* show how the thick pads of FIG. 3 are inserted into the pad pockets 2 and 4, thus stretching them outwards from the surface of the trousers 1 in such a way that the inner dimensions of the trousers 1 remain substantially unchanged for the convenience of the wearer. Due to the elastic pad pocket material, such as stretch KEVLAR® aramid synthetic fiber material, the pad pockets 2 and 4 bear relatively tightly against the pads, keeping them steadily in position and preventing them from moving or taking the wrong position in the event of falling or other such forces.

FIG. 7 in turn shows the coat of FIG. 3 with the thick pads of FIG. 5 fitted in place. It appears from FIG. 7 that the pad pockets, made of a suitable elastic material, such as stretch KEVLAR® aramid synthetic fiber material, stretch outwards as required by the pads. Thereby the outer dimensions of the pad pockets are increased while the inner dimensions of the coat remain substantially unchanged.

In the above description and the attached drawing the athletic outfit of the invention has been described by way of example. An advantage of the athletic outfit of the invention is that it can be worn without pads as ordinary clothing or with pads of various kinds and sizes and of varying protection effect at suitable points where the pockets are provided according to the invention. Even though only a few locations and designs for the pads are disclosed in the figures and the description, the pockets can be positioned at various points and in various ways on the sides, front and back of the coat and the trousers according to the requirements of the sport in question. The pads can be made of any suitable material, provided that they can be inserted into the pockets and that they follow sufficiently the shape of the garment when it is bent. The athletic outfit may consist of a coat and trousers or an overall. Various other embodiments are possible as well. The elastic material of the pad pockets is preferably stretch KEVLAR® aramid synthetic fiber material as it withstands rubbing and wear but stretches sufficiently to enable the pads to be positioned in place. The outfit is preferably made of GORE-TEX® coated CORDURA®, whereby its properties and airiness enable optimal performance and convenience. In place of the VELCRO® hook and loop tape fastening it is possible to use any other suitable fastening means which keep the pads within the pockets under all circumstances. Otherwise the structure and other details of the outfit may vary in a manner known per se without affecting the scope of protection of the invention, which is defined in the claims.

I claim:

1. An athletic garment for use by a person engaged in sports activities, said athletic garment comprising:

a body material formed as an article of clothing which is elastic and permeable to moisture, a piece of pocket material having an edge with a first portion and a second portion, and wherein said pocket material is only attached along said first portion of said edge to said body material to provide a pocket on an outer side of said body material where impacts can be expected, and wherein said second edge portion is unattached and provides an opening into said pocket, said pocket material being elastic, a fastening means for closing said opening to said pocket, and a removeable pad which is insertable through said opening and into said pocket, said removeable pad being shaped so as to fill said pocket and cause said pocket material to expand while said body material does not stretch, said pocket material being expandable to accomodate removeable pads of differing thicknesses.

2. An athletic garment according to claim 1, including a plurality of pieces of pocket material attached to said body material to provide a plurality of pockets on said outer side of said body material where impacts can be expected, a plurality of fastening means for respectively closing the openings to said pockets, and a plurality of removable pads for respective insertion into said pockets.

3. An athletic garment according to claim 2, wherein said body material comprises trousers having hip and knee areas and wherein said pockets are provided in said hip and knee areas.

4. An athletic garment according to claim 2, wherein said body material comprises a coat having elbow and shoulder areas and wherein said pockets are provided in said elbow and shoulder areas.

5. An athletic garment according to claim 1, wherein said pocket material is composed of stretch aramid synthetic fibers.

6. An athletic garment according to claim 1, wherein said fastening means comprises cooperable hook and loop tapes attached to said body material and said piece of pocket material.

7. An athletic garment according to claim 1, wherein said removable pad comprises a sheet element and a plastic cup attached to said sheet element.

8. An athletic garment according to claim 1, wherein said body material is impermeable to water.

* * * * *